United States Patent [19]

Kendrick

[11] 4,071,245

[45] Jan. 31, 1978

[54] BOARD GAME

[76] Inventor: Robert H. Kendrick, 5007 W. 67th Terrace, Shawnee Mission, Kans. 66208

[21] Appl. No.: 768,188

[22] Filed: Feb. 14, 1977

[51] Int. Cl.[2] ..... A63F 3/00

[52] U.S. Cl. ..... 273/243 GA; 273/284

[58] Field of Search ... 273/134 G, 134 GA, 134 GM, 273/134 AD, 134 D, 134 E, 134 B, 136 E, 137 R, 134 GB, 131 B, 131 AB

[56] References Cited

U.S. PATENT DOCUMENTS

| | | | |
|---|---|---|---|
| 437,838 | 10/1890 | Sperl | 273/131 AB |
| 1,077,865 | 11/1913 | Atkins | 273/134 AD |
| 2,162,876 | 6/1939 | Barton | 273/131 B |
| 2,585,268 | 2/1952 | Olsen | 273/131 B |
| 2,732,211 | 1/1956 | Foster | 273/131 AB |
| 2,811,361 | 10/1957 | Woolrich, Jr. | 273/134 GA |
| 3,309,092 | 3/1967 | Hardesty et al. | 273/134 GA |
| 3,642,286 | 2/1972 | Moore | 273/134 AD |
| 3,692,310 | 9/1972 | Martin | 273/134 GA |
| 3,820,791 | 6/1974 | Powers | 273/131 B |
| 4,002,341 | 1/1977 | Chin | 273/134 GB |

*Primary Examiner*—Harland S. Skogquist
*Assistant Examiner*—Harry G. Strappello
*Attorney, Agent, or Firm*—Watson, Cole, Grindle & Watson

[57] ABSTRACT

A board type amusement game particularly adapted for play by children is disclosed. The games includes a plurality of generally cubical game pieces which have at least three different indicia, preferably colors, on separate surfaces thereof. Also included is a generally rectangular, three dimensional game board having a plurality of recesses on a major surface thereof. Each recess of the game board is adapted to receive a game piece such that the top surface of the game piece is visible. The surface of the game board has indicia thereon for indicating paths between adjacent recesses. The game further includes a plurality of movement pieces, each having an indicium thereon corresponding to one of the indicia on the game pieces and chance means for determining allowable movement of the movement pieces on the game board.

10 Claims, 5 Drawing Figures

BOARD GAME

BACKGROUND OF THE INVENTION

The present invention relates to board type amusement games and more specifically to a board type amusement game particulary adapted for play by children which is relatively simple to play and yet provides sufficient variety that the game may be played repeatedly without loss of enjoyment.

Various board type amusement games are known in the art of which U.S. Pat. Nos. 722,668 to Bennett, 1,642,711 to Alfonso, 1,335,088 to Blumenfeld, 3,434,719 to Fyanes, 3,603,591 to Shoptaugh and 3,820,791 to Powers are a selected sample. While these type of games are satisfactory in most respects, it is desirable to create new games to meet the changing tastes of the consuming public, especially children, who eventually tire of playing a particular game and thereby create a demand for different games.

SUMMARY OF THE INVENTION

It is therefore an object of the present invention to provide a board type game particularly adapted for play by children which tends to maintain interest in the game even after repeated plays. Another object of the present invention is to provide a board type game which is relatively uncomplicated yet provides sufficient variety in play. A further object of the present invention is to provide a board type game whose outcome is primarily determined by chance yet includes a sufficient element of skill to stimulate interest. Another object of the present invention is to provide a game which can be manufactured relatively economically and easily. Yet another object of the present invention is to provide a game which may yield educational benefits for children.

In its broadest aspects, the present invention comprises a board type amusement game comprising a plurality of generally cubical game pieces each having at least three different indicia on separate surfaces thereof, a three-dimensional game board having a playing surface and a plurality of recesses in the playing surface, each recess being adapted to receive a game piece such that at least one surface of the game piece is visible, the game board further including indicia thereon for delineating a path between adjacent recesses, a plurality of movement pieces each having an indicium thereon which corresponds to one of the indicia on the game pieces and chance means for determining movement of the movement pieces on the playing surface.

Further objects, features and advantages of the present invention will become more fully apparent from a detailed consideration of the remainder of this disclosure and the appended claims in conjunction with the accompanying drawings.

DETAILED DESCRIPTION OF THE PREFERRED EMBODIMENTS

Figure 1:
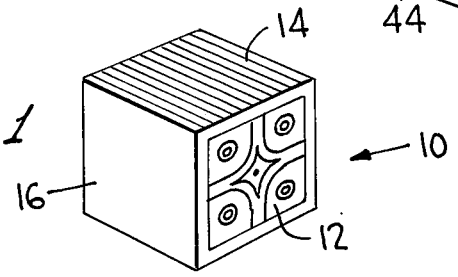
FIG. 1 is a perspective view of one embodiment of a game piece forming a part of the present invention.

Referring now to FIG. 1, there is shown one embodiment of a game piece 10 forming a part of the present invention. The game piece 10 is of a cubical shape and has at least three different indicia on separate surfaces thereof. As shown in the drawing, game piece 10 has an embossed type pattern on surface 12 serving as one indicium. Surfaces 14 and 16 of game piece 10 are of different colors serving as two other indicia. In a preferred embodiment, two of the three surfaces of the game piece 10 which are not shown each are a different color than the colors of surfaces 14 and 16 and the third surface is the same as surface 12. For the convenience of the players, it is preferred that the surface 12 and the surface not shown which is the same as surface 12 be of the same color but of a different color than the other surfaces of the game piece 10. In a presently preferred form, the game piece 10 is a cube of about one half to about one and a half inches per side.

Figure 2:
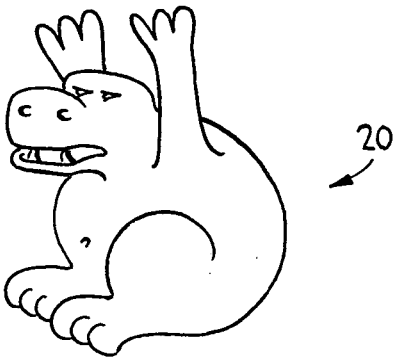
FIG. 2 is side view of one embodiment of a movement piece forming a part of the present invention.

FIG. 2 illustrates one embodiment of a movement piece which forms a part of the present invention. The movement piece 20 shown is in the shape of a fanciful animal-like figure. In accordance with the present invention, the movement piece 20 carries an indicium corresponding to one of the indicia on a game piece 10. In the embodiment shown, the movement piece 20 is of a color corresponding to the color on the surface 16 of game piece 10. The movement piece 20 should be of small enough dimensions so as to fit comfortably on a surface of a game piece 10. The game of the present invention includes a plurality of these movement pieces 20, generally one movement piece for each player of the game, with each movement piece carrying a different indicium.

The game pieces 10 and the movement pieces 20 may be made of any suitable material such as wood, plastic, metal, ceramic or the like. For economy of manufacture, plastic type material which can be readily molded is generally preferred.

Figure 3:
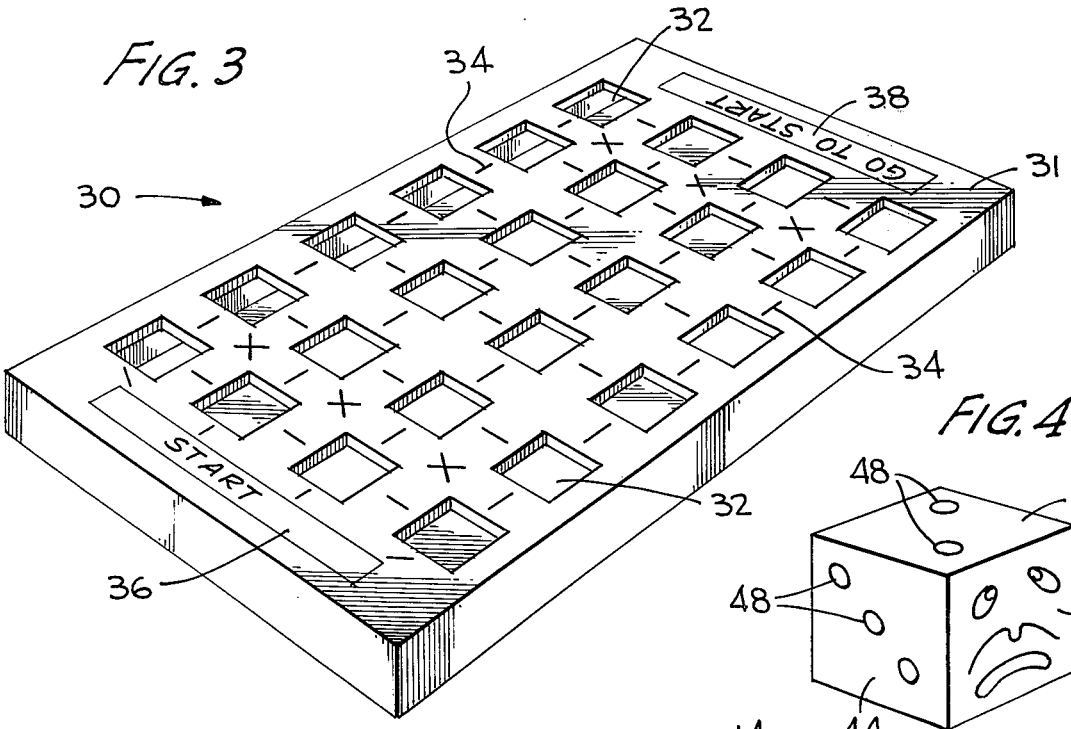
FIG. 3 is perspective view of one embodiment of a game board forming a part of the present invention.

Referring now to FIG. 3, there is shown a generally rectangular game board 30 which forms another part of the present invention. The game board 30 is three-dimensional with a playing surface 31 and includes a plurality of recesses 32 each of which is adapted to receive a game piece 10 as shown in FIG. 1. Preferably the recesses 32 are of sufficient depth so that only the top portion of a game piece 10 will be visible. On the playing surface 31 of game board 30 are indicia 34 which indicate paths between adjacent recesses 32. The indicia 34 may take a variety of forms including the straight line segments as shown in the FIGURE. Alternatively, the indicia 34 on the surface 31 may be a color or colors which contrast with the color of the remainder of the surface, dots, arrows, shapes, raised or depressed areas and the like. The paths formed by the indicia 34 are used in playing the game to indicate allowable directions of movement of the movement pieces 20. Also located on the playing surface 31 is start area 36 which also may take a variety of forms. During the play of the game, the movement pieces 20 are initially placed on area 36 to begin the game. On the end of the board 30 opposite the start area 36 is a similar area 38 which, as is shown, is termed a "go to start" area. This area 38 provides, during the play of the game, a means for allowing movement pieces 20 to return to the start area 36.

On the surface 31 of the game board 30 in close proximaty to each recess 32 may be a locating indicium (not shown) which corresponds to one of the indicia on the game pieces 10. The locating indicia may be used to initially place the game pieces 10 in the recesses 32 in an orientation such that the indicium on the surface of each game piece corresponding to the locating indicium becomes the top of the game piece and is therefore visible. Thus, if the indicia on the game pieces 10 are colors, for convenience the locating indicia may be colors also. Preferably there are an equal number of the various types of locating indicia.

The game board 30 may be made of any suitable material such as wood, plastic, paper, cardboard, pasteboard and the like or laminates thereof. For economy of manufacture, a cardboard or pasteboard sheet with square apertures to form the recesses 32 may be folded and joined so as to produce a three-dimensional game board 30. In addition, a conventional game box of a slightly larger size than the game board 30 may be utilized in conjunction with the game board to provide additional strength for the game board and to provide a convenient storage for the remainder of the game equipment.

Figure 4:
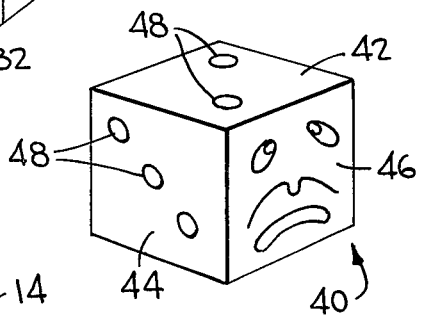
FIG. 4 is a perspective view of one type of chance means which may form a part of the present invention.

FIG. 4 illustrates one type of chance means that may be used to determine movement of movement pieces 20 during the play of the game of the present invention. The chance means shown is a cube 40 to be used in the manner of a die which carries movement determining type indicia on the surfaces thereof. In the embodiment shown, surface 42 of cube 40 carries two dots 48 and surface 44 carries three dots 48, the number of dots indicating the number of moves or steps a movement piece 20 may take on the game board 30. Surface 46 carries a fanciful type face which indicates that no movement of a movement piece 20 may take place. In this embodiment of the chance means, of the three surfaces of cube 40 which are not shown, one surface carries one dot and the other two surfaces carry a fanciful face identical to the face carried on surface 46.

Figure 5:
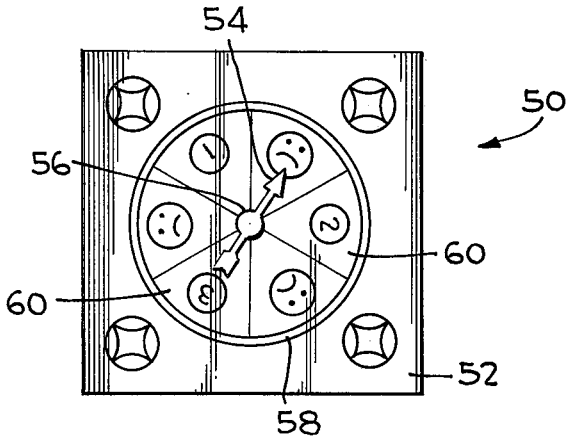
FIG. 5 is a plan view of another type of chance means which may form a part of the present invention.

FIG. 5 illustrates another type of chance means that may be used to determine movement of movement pieces 20 during the play of the game of the present invention. The chance means is a spinner 50 including a planar surface 52 and arrow-like member 54 rotatably mounted on an axis 56 which projects from the planar surface. Formed on surface 52 is circular area 58 divided into pie-shaped sections 60, each section having an indicium for indicating allowable movement of a movement piece 20. In the embodiment shown, each section 60 has either a numeral or fanciful face thereon which indicates allowable movement in the same manner as the indicia on cube 40 of FIG. 4.

It should be understood that the indicia on the chance means could take many other forms than those illustrated in FIGS. 4 and 5. For example, the cube 40 could have indicia thereon such that it resembles a conventional die. In addition, the chance means forming a part of the present invention could be of other types such as a plurality of cards, chips or the like having various movement determining indicia thereon which are drawn one at a time by the respective players of the game.

The most preferred game according to the present invention includes the game board as shown in FIG. 3 having 24 recesses 32, a like number of cubical game pieces 10 having four surfaces each of a different color and the other two surfaces having an embossed type pattern, four different colored movement pices 20 where each is of a color corresponding to one of the colors of the game pieces, and a die-like chance means 40 as shown in FIG. 4. Locating indicia on the board 30 are dots of the same four colors as the game pieces 10 and there are six locating indicia of each color. The location of the six indicia of each color on the board 30 relative to one another is scattered rather than being in a regular pattern or all being located adjacent to one another. Each player of the game is to have one movement piece 20 and thus the most preferred game may be played by up to four players.

A preferred method of play of the above most preferred game is as follows. For the sake of clarity, it will be assumed that there are four players. To start the game, each player selects a movement piece 20 and places the piece on the start area 36 of the game board 30. The game pieces 10 are then placed in the recesses 32 of the board 30 such that the colored surface of the piece corresponding to the locating indicium of each recess is up and therefore visible. For example, if the locating indicium nearest a particular recess 32 is of a red color, the game piece 10 is placed in the recess such that a red surface is up and therefore visible. Thus each player will have six game pieces 10 with a visible surface having a color corresponding to the color of his movement piece 20.

One player is then selected to start the game by rolling the die 40. The selected player then rolls the die again and moves his movement piece 20 the number of steps shown on the die. The movement of a movement piece 20 from the start area 36 to an adjacent game piece 10 or from one game piece to an adjacent game piece counts as one step. If the roll of the die 40 indicates the face of surface 46, the player is not allowed to move his movement piece 20. To move the movement piece 20 from one game piece 10 to an adjacent game piece, there must be a path on the board 30 connecting the two pieces. The movement of a movement piece 20 from one game piece 10 to another along the paths must be made so that the movement piece is no nearer to the start area 36, that is, the movement piece may move forward, sideways and diagonally away from the starting area but not backwards or diagonally toward the starting area. Each player in succession then rolls the die 40 and moves his respective movement piece 20 in the same manner. Each sequence of one player rolling the die 40 and moving his movement piece 20 in accordance with the roll of the die is termed a turn.

When a movement piece 20 reaches a game piece 10 adjacent to the "go to start" area 38 either during a turn or at the end of a turn, the movement piece may be moved in one additional step onto the "go to start" area and then in subsequent step moved back onto the start area 36 where play continues as in the manner of the beginning of the game.

During the movement of a movement piece 20 in a turn, the movement piece cannot go over a game piece 10 that is occupied by another movement piece, but a movement piece can finally rest on a game piece occupied by another movement piece unless the other movement piece is "safe" as is defined hereinafter.

If, after a turn, a movement piece 20 rests upon a game piece 10 with a visible surface of a color different than the color of the movement piece, that game piece may be "captured" on the next succeeding turn by moving the movement piece off that particular game piece. When a game piece 10 is "captured", it is removed from its recess 32 and replaced in the same recess in a different orientation such that the surface having the color corresponding to the color of the movement piece 20 is on top and therefore visible. If a movement piece 20 leaves a game piece 10 having a visible color the same as the movement piece, the game piece remains as it was.

If, after a turn, a movement piece 20 rests on a game piece 10 already occupied by another movement piece, the movement piece initially on the game piece is immediately moved back to the start area 36 and all game pieces having a visible surface of the same color as that movement piece just placed at the start area are removed from their respective recesses 32 and replaced such that the surface 12 having an embossed pattern is visible. If none of the game pieces 10 have that particular color visible, the player whose movement piece was to be moved back to the start area is then out of the game and his movement piece is removed from the board. Once a game piece 10 has been replaced in a recess 32 with the surface 12 having an embossed pattern visible, it can no longer be captured.

When a movement piece 20 is resting upon a game piece 10 with a surface visible that is the same color as the movement piece, that movement piece is "safe" and it is not required to go back to the start area 36 nor will the game pieces having that same color visible be changed if another movement piece is able to occupy that same game piece. Since the first movement piece 20 is "safe", the movement piece which could occupy that game piece 10 within its turn must end the turn on another game piece.

The winner of the game is the last player whose movement piece still remains on the board.

In the situation where there are less than four players to play the game, only minor modifications need to be made in the method of play as set forth above. In such situations, the locating indicia on the board 30 are ignored and the game pieces 10 are placed in the recesses 32 of the board such that each player has an equal number of game pieces having a visible surface of the same color as their movement piece 20. Thus, when there are three players, each player will have eight game pieces 10 having a visible surface of the color of his movement piece 20. To increase the playability of the game, game pieces 10 having the same color visible should be scattered about the board 30 rather than all being placed adjacent to one another.

As is apparent from the above preferred method of play, the outcome of the game is largely determined by chance but an element of skill enters in determining the optimum path of movement for a movement piece. Thus the game is particularly adaptable for play by children in that the rules of play are not complicated yet the skill element allows for variety in the game and enhances interest in playing the game repeatedly. In addition, valuable educational benefits may be realized by children in playing the game including practice in counting, number recognition, color discrimination, reading and comprehension of written matter, hand-to-eye coordination and the like.

While the present invention has been described with reference to particular embodiments thereof, it will be understood that numerous modifications may be made by those skilled in the art without actually departing from the spirit and scope of the invention as defined in the appended claims.

I claim:

1. A game comprising a plurality of generally cubical game pieces each having at least three different indicia on separate surfaces thereof, a three-dimensional game board having a playing surface and a plurality of recesses on the playing surface, each recess adapted to receive a game piece such that at least one surface of the game piece is visible, said game board further including indicia thereon for indicating a path between adjacent recesses, a plurality of movement pieces each having an indicium thereon which corresponds to one of the indicia on the game pieces, and chance means for determining movement of the movement pieces.

2. A game as set forth in claim 1 wherein said indicia on said game pieces include different colors.

3. A game as set forth in claim 1 wherein said game pieces each have five different indicia.

4. A game as set forth in claim 1 wherein said chance means is at least one die.

5. A game as set forth in claim 4 wherein said chance means is a cube having the same indicia on three surfaces and one indicium representing one, two or three on each of the other three surfaces.

6. A game as set forth in claim 1 wherein each said recess in said board is formed by a generally square aperture in the playing surface.

7. A game as set forth in claim 1 wherein said chance means is a spinner.

8. A game as set forth in claim 1 wherein said movement pieces have an animal-like shape.

9. A game as set forth in claim 2 wherein each game piece has two surfaces of the same color having an embossed type pattern thereon and the four other surfaces are each of a different color.

10. A game as set forth in claim 1 wherein the playing surface of the game board includes at least two areas where movement pieces may be placed.

* * * * *